United States Patent [19]

Winkler et al.

[11] 4,235,572

[45] Nov. 25, 1980

[54] ROTARY DISPLACEMENT PUMP WITH INTAKE THROUGH A FIRST SEALING SLIDE

[75] Inventors: Otto Winkler, Balzers; Eberhard Moll, Triesen, both of Liechtenstein

[73] Assignee: Balzers Aktiengesellschaft für Hochvakuumtechnik und Dünne Schichten, Liechtenstein

[21] Appl. No.: 964,874

[22] Filed: Nov. 30, 1978

[30] Foreign Application Priority Data

Dec. 1, 1977 [CH] Switzerland ..... 14692/77

[51] Int. Cl.[3] ..... F04C 18/02; F04C 23/00; F04C 29/08

[52] U.S. Cl. ..... 418/6; 418/59; 418/60; 418/64; 418/183

[58] Field of Search ..... 418/6, 56, 59, 63, 64, 418/67, 183, 60

[56] References Cited

U.S. PATENT DOCUMENTS

| | | | |
|---|---|---|---|
| 1,493,268 | 5/1924 | Kinter | 418/65 |
| 1,780,109 | 10/1930 | Berglund | 418/59 |
| 2,073,101 | 3/1937 | Fox | 418/59 |
| 2,100,014 | 11/1937 | McCracken | 418/64 |
| 3,125,032 | 3/1964 | Smith | 418/59 |
| 3,563,678 | 2/1971 | Sadler | 418/64 |
| 3,782,865 | 1/1974 | Braun | 418/56 |
| 4,086,039 | 4/1978 | Ettridge | 418/64 |

*Primary Examiner*—John J. Vrablik
*Attorney, Agent, or Firm*—McGlew and Tuttle

[57] ABSTRACT

A rotary displacement pump comprising a casing including a cylindrical inner surface defining a stator chamber with an inlet and an outlet connected thereto. A cylindrical displacement body is movably mounted within the stator chamber having an outer surface which is movable into close association with the cylindrical inner surface along a line. A shaft is provided with an eccentric connected to the displacement body with a bearing to eccentrically move the displacement body within the stator chamber and move the line of close association in a circular path within the stator chamber. Gas tight spring bodies are connected between the displacement body and the casing for preventing rotation of the displacement body with respect to the casing and the displacement body is provided with first and second slide sealing members for dividing the stator chamber into an inlet base and an outlet base.

10 Claims, 4 Drawing Figures

ROTARY DISPLACEMENT PUMP WITH INTAKE THROUGH A FIRST SEALING SLIDE

BACKGROUND OF THE INVENTION

1. Field of the Invention

The present invention relates in general to vacuum pumps and in particular to a new and useful rotary displacement pump which may be used to establish a high or ultra-high vacuum without contamination from lubricants or other unwanted gases produced by components of the pump.

2. Description of the Prior Art

Many applications require the production of high to ultrahigh vacuum, with a residual gas atmosphere free from carbon dioxide. To this end, mostly the prior art "dry" pumping systems are usually employed, such as ion getter pumps, sublimation pumps, cryogenic pumps, and turbo-molecular pumps. Further, to securely prevent a contamination of the container with hydrocarbons, it is desirable to avoid using oil-lubricated or oil-sealed forepumps during a pre-evacuation stage going from atmospheric pressure to a level at which these pumps start operating. That is why sorption pumps, for example, are employed which, however, are satisfactorily efficient only if a coolant such as liquid nitrogen is used. These pumps need regeneration so that their handling is too complicated to be suitable for manufacturing purposes where an automation of the pumping process is increasingly required.

What is needed is a pump which is instantly ready for operation in the same way as the mechanical pumps hitherto employed in industrial processes. The pump should be capable, without requiring a regeneration, of compressing to atmospheric pressure and discharging even large amounts of gas. On the other hand, the pump should not contain, in the pump chamber, any lubricants or sealing means which give off gas.

Attempts have already been made to use mechanical forepumps, such as piston valve pumps with dry running carbon sliders or Roots-type pumps, where hydrocarbons are avoided as sealing means in the pump chamber. As long as such pumps are provided with lubricated bearings, however, they are never completely secure against leakage of the lubricant, not even with the usual sealing sleeves or sliding packings between the bearings and the pump chamber. A completely satisfactory solution is obtained only with a truly gastight separation of the bearings from the pump chamber, for example, by means of resilient metallic or plastic bodies. Since such bodies may be allowed only to bend and must not be subject to torsion, the sole kind of motion resulting therefrom, for the displacer performing the pumping, is an oscillatory movement without rotation.

Even though the bearing and drive problem may be solved in this way, still further factors are to be taken into account in high-speed dry pumps:

In principle, sliding parts producing abrasion and heat in long-term operation should be avoided. From this requirement it follows that the gaps should be as long as possible, since their width cannot drop below a certain minimum given by the manufacturing tolerances and the unequal coefficient of expansion of the component parts. This is done so as to obtain, in spite of the absent lubricant and sealing means, low conduction values between the discharge and suction sides of the pump.

Should sliding parts not be avoidable for obtaining a high compression ratio, at least the contact pressure of the surfaces sliding on each other and their sliding speed should be minimized.

Another important requirement is to have a small dead space in the pump, since only then can high compression ratios and low ultimate pressures be obtained with few stages. Also, additional measures should be taken at the suction side of the pump to prevent a back flow of gases which have already been displaced, to the intake.

There have already been provided dry mechanical pumps in which the above described separation of the drive and the bearings from the pump chamber is effected by means of metallic or plastic spring bodies. Such is the design, for example, of a pump with a cylindrical pump chamber according to Luxembourgian Pat. No. 53323 or the U.S. Pat. No. 3,782,865 and of a pump with a spiral pump chamber according to Swiss Pat. No. 514,787. The first-named design does avoid sliding parts in the delivery space, but has the disadvantage of a large dead volume at the discharge side. This causes a permanent high pressure difference between the discharge side and the suction side leading to considerable leakage losses in the seal gaps and resulting in too low a compression ratio. To obtain the desired ultimate pressure, many such pump stages would have to be connected in series and the costs would rise correspondingly.

In the pump with a spiral pump chamber, the conditions are substantially better in this respect. Its application on a large scale, however, is hindered by the fact that such an embodiment is relatively complicated and expensive in manufacture, since relatively close manufacturing tolerances are to be observed in the absence of sealing means.

SUMMARY OF THE INVENTION

The present invention is directed to a pump which provides an optimal compliance with all the aforementioned requirements and to a solution which, as to expenditures, life, and performance, would correspond to what a user employing the device in a processing plant must require.

It has been found that only a cylindrical pump casing with an eccentrically disposed cylindrical displacer ensures a simple and inexpensive manufacture. A small dead space, however, is obtainable only by means of an inserted sealing slider separating the discharge side of the pump from the intake side. The slider can be mounted in the fixed part of the housing or in the displacer. Since it is a sliding part, the sole one in the dry section of the pump, its pressure on the contacting surface should remain small. Acceleration forces in the direction of the contact area should be avoided if possible. It is therefore advantageous to mount the slider in the displacer, so that no radial displacement occurs. Then, a very small contact pressure, effected by a spring, is sufficient to obtain a secure sealing at the line of contact with the cylindrical surface of the housing.

The oscillatory motion of the displacer causes a lateral reciprocating motion of the slider, which is perpendicular to the large surface of the slider and has an amplitude corresponding to the eccentricity of the drive. The rubbing speed on the cylinder surface or surfaces of the stator is very low so that with the small contact pressure, the wear is minimized. The laterally effective acceleration forces are absorbed by the guide surfaces which are so large that, here again, the specific contact pressure is satisfactorily reduced. Advantageously, the material for the slider is a plastic impregnated with a dry lubricant, for example, molybdenum sulfide.

Another provision for obtaining a high compression ratio is that, at the instant at which the separation of the discharge and intake spaces is accomplished and the pressures are equalized, the intake port is closed and remains closed until a compression space is formed again.

Accordingly an object of the present invention is to provide a rotary displacement pump comprising a casing including a cylindrical inner surface defining a stator chamber, an inlet connection connected to said casing and communicating with said stator chamber, an outlet connected to said casing and communicating with said stator chamber, a displacer body mounted for non-rotational eccentric motion within said stator chamber having an outer cylindrical surface movable into close association with said cylindrical inner surface of said casing along a line, eccentric mounting means connected to said displacer body for moving said displacer body and moving said line of close association in a circular path around said stator chamber, said displacer body movable into a dead center position with said line of close association in a vicinity of said inlet connection, gas tight spring body means connected between said displacer body and said casing for separating said stator chamber from said eccentric mounting means and preventing rotation of said displacer body, a first slide sealing member connected to said displacer body and movable therewith to close said stator chamber to said inlet connection until said displacer body moves past its dead center position, a second slide sealing member slidably mounted in said displacer body and engaged with said cylindrical inner surface of said casing at a location between said inlet and outlet connections for separating said stator chamber into an inlet space and an outlet space.

Since it is not necessary, in view of the low relative speeds between the displacer and the stator and the small contact pressures, to eliminate sliding parts, even though this has hitherto been considered an unavoidable prerequisite for being able to dispense with lubricants giving off vapors, the inventive design makes it possible for the first time to provide a simple geometry of all component parts while ensuring a high vacuum quality, i.e. a high compression ratio and low ultimate pressure of the pump.

Another advantage of the inventive pump is that the center of gravity of the displacer moves at a uniform speed along a circular path about the axis of rotation whose radius corresponds to the eccentricity, so that oscillatory motions about the center of gravity are avoided and the imbalance of the displacer can be completely eliminated by means of compensating masses supported on the shaft. This also allows relatively high speeds to be attained in operating the inventive pump.

The inventive pump is particularly suitable for application in the chemical industries. There, the possibility of a complete separation of the bearings from the oil circulating in the pump, to prevent a corrosion of the bearings, is a very important factor extending the life of the pump.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following, the invention is described in more detail while considering the embodiments shown in the drawings in which.

DESCRIPTION OF THE PREFERRED EMBODIMENT

Figure 1:
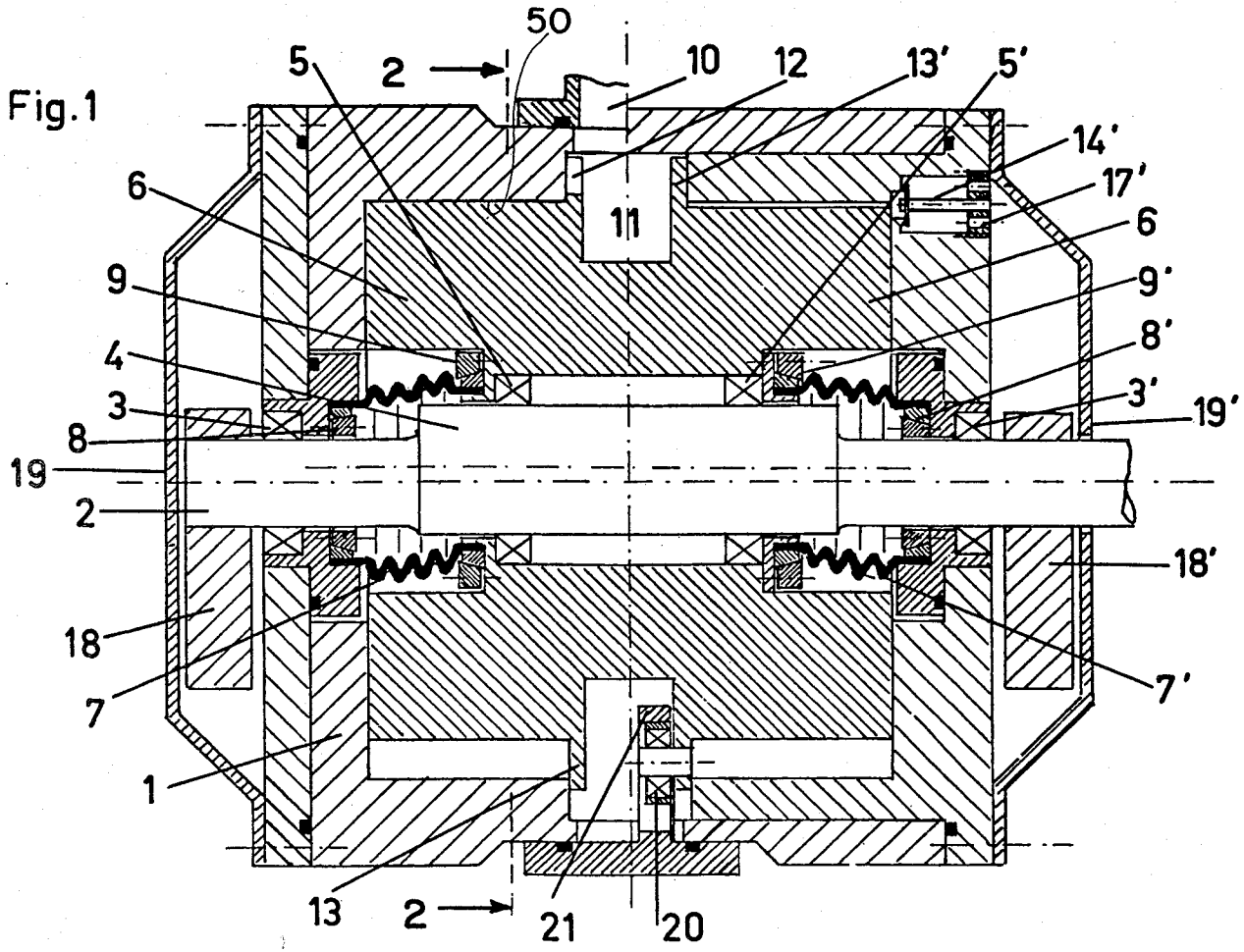
FIG. 1 is an axial sectional view of a first embodiment of the invention.
Figure 2:
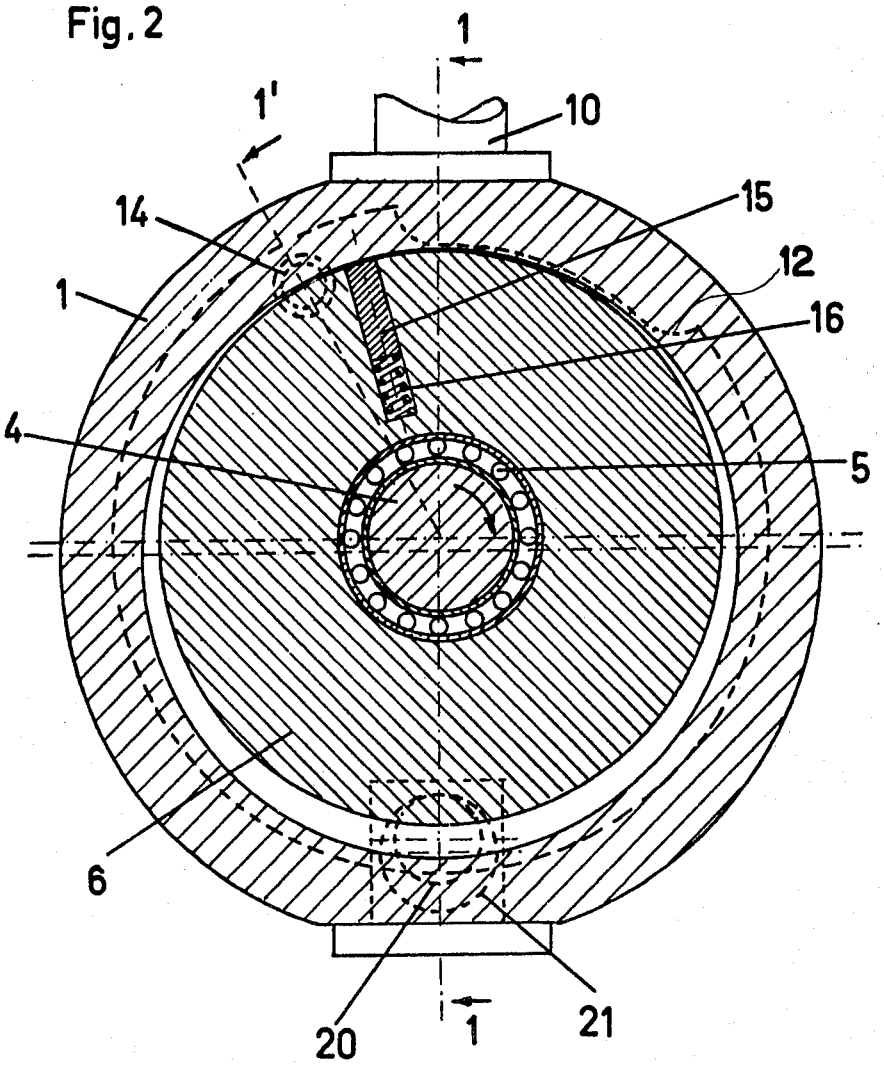
FIG. 2 is a sectional view perpendicular to the axis and taken along the lines 2—2 of FIG. 1, the left-hand portion of FIG. 1 corresponds to the section line 1—1 of FIG. 2 and the right-hand portion corresponding to the section line 1'—1 of FIG. 2.

Referring now to the drawings in particular the invention embodied therein in FIGS. 1 and 2 comprise a rotary displacement pump having a casing 1 with an inner cylindrical surface 50 which defines a stator chamber and a cylindrical displacer body 6, 6' movable therein.

The pump casing 1 forms a cylindrical stator space and the drive shaft 2 is mounted by means of ball bearings 3, 3' on either front side thereof. The drive shaft carries an eccentric 4 secured thereto and supporting, by means of ball bearings 5, 5', the displacer body of the pump comprising a left-hand portion 6 and a right-hand portion 6' which, along with the pump casing, form each one pumping stage, the stages being connected parallel to each other. To hermetically separate the pumping stages from bearings 3, 3' and 5, 5', elastic spring bodies 7, 7' are provided on both sides which, as shown in the drawings, are hermetically secured to the bearing box and the displacer body by means of pairs of conical rings.

The gas to be pumped is taken in through an inlet line 10 and dispersed into an annular groove 11 provided circumferentially in the displacer. From this groove and at every time shortly after the displacer moves beyond the position shown in FIGS. 1 and 2, the gas passes, through recesses 12, (one of which is shown) provided in rings or first slide sealing members 13, 13' which are connected to the displacer and serve the purpose of laterally sealing the right-hand and left-hand pumping stages during the further pumping phases, into the intake spaces of the two pumping stages. The position of displacer 6, 6' in FIGS. 1 and 2 is the so-called dead-center position of the displacer during to operation of the pump.

Having entered these spaces, the gas is displaced in the direction of discharge valves 14 (FIG. 2) and 14' (FIG. 1) of the two pumping stages by the continuing motion of the displacer. During this motion the sealing line formed by the displacer and the inside surface of the stator chamber revolves clockwise as viewed in FIG. 2, but the displacer itself does not perform a rotary motion. During this phase, the intake space remains continuously separated from the discharge space of the pump by sliders or second slide sealing members, of which only one is shown in FIG. 2 at 15, which are movable in radial slots of the displacer and pressed radially outwardly, against the inside wall surface of the stator, by springs (16 in FIG. 2). As soon as the necessary pressure in the compression space is attained, the discharge valves open and the compressed gas passes to the outside through respective ports (17' in FIG. 1).

As further shown in FIG. 1, imbalance compensating weights 18, 18' are secured to shaft 2 on both sides of the pump and protective caps 19, 19' are provided having apertures permitting an unhindered exit of the gas.

During the delivery phase of the pump, a torque appers at the displacer which must not become too strong, to avoid an excessive load on spring bodies 7, 7'. To positively prevent this from happening, a safety mechanism may be provided which counteracts this torsion. An example of this safety means is as follows: A ball bearing 20 with a race is secured to the displacer in the annular space 11, which, to permit a dry run, may be equipped with silver-coated balls or with a teflon cage, for example, and moves within a stationary ring 21 fixed to the pump casing. This prevents any rotary motions of the displacer 6, 6'. Instead of a single one, a plurality of such mechanisms preventing rotation may be provided in annular space 11, distributed over the circunference of the displacer.

It will be understood that the described pump may also be designed with a single pumping stage, in which case the gas may be supplied at one of the front sides. The shown embodiment, however, with the gas supply in the plane of symmetry of the pump casing and with two parallel connected single stages, has proved advantageous from a constructional point of view.

Figure 3:
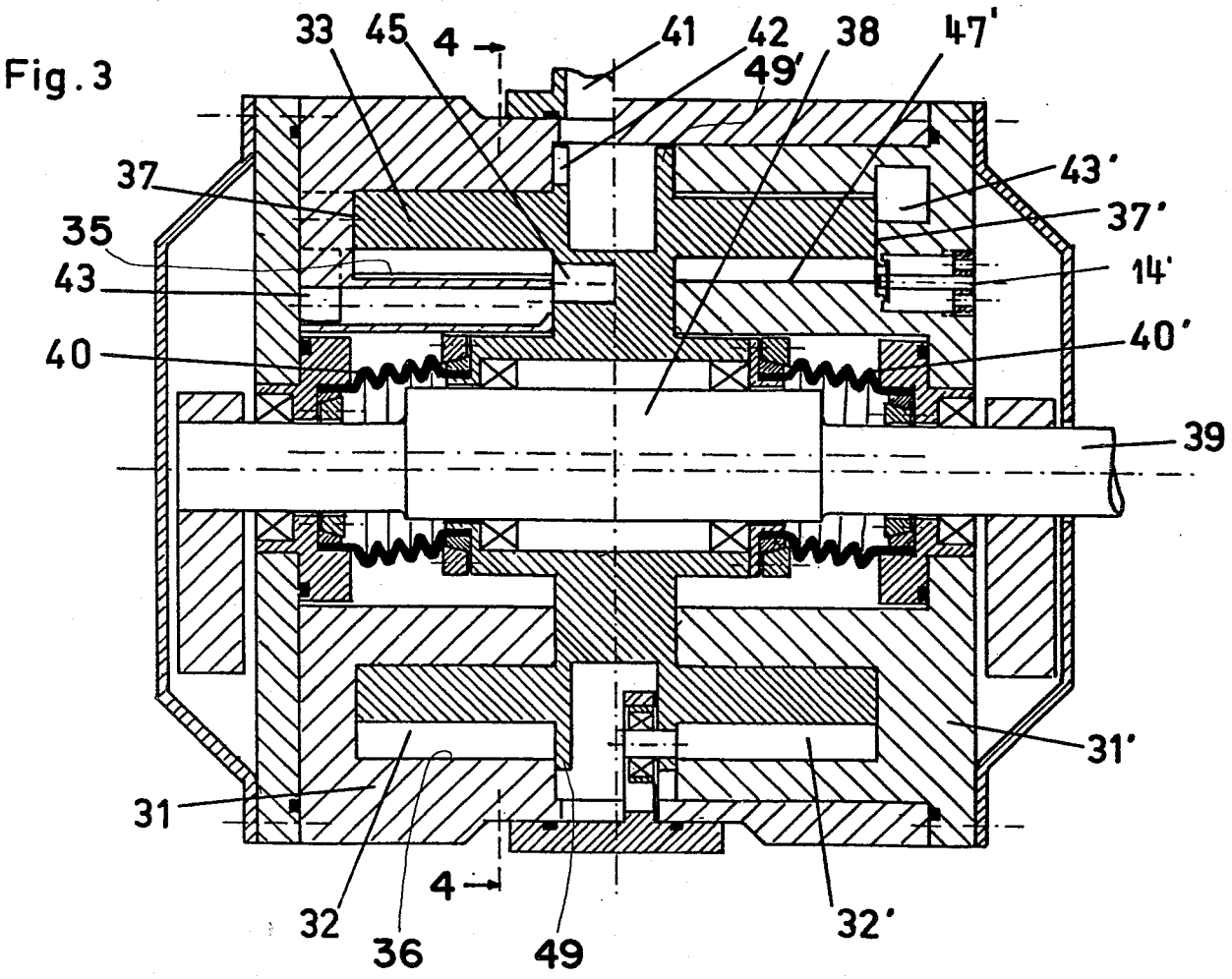
FIG. 3 is a view similar to FIG. 1 of another embodiment of the invention.
Figure 4:
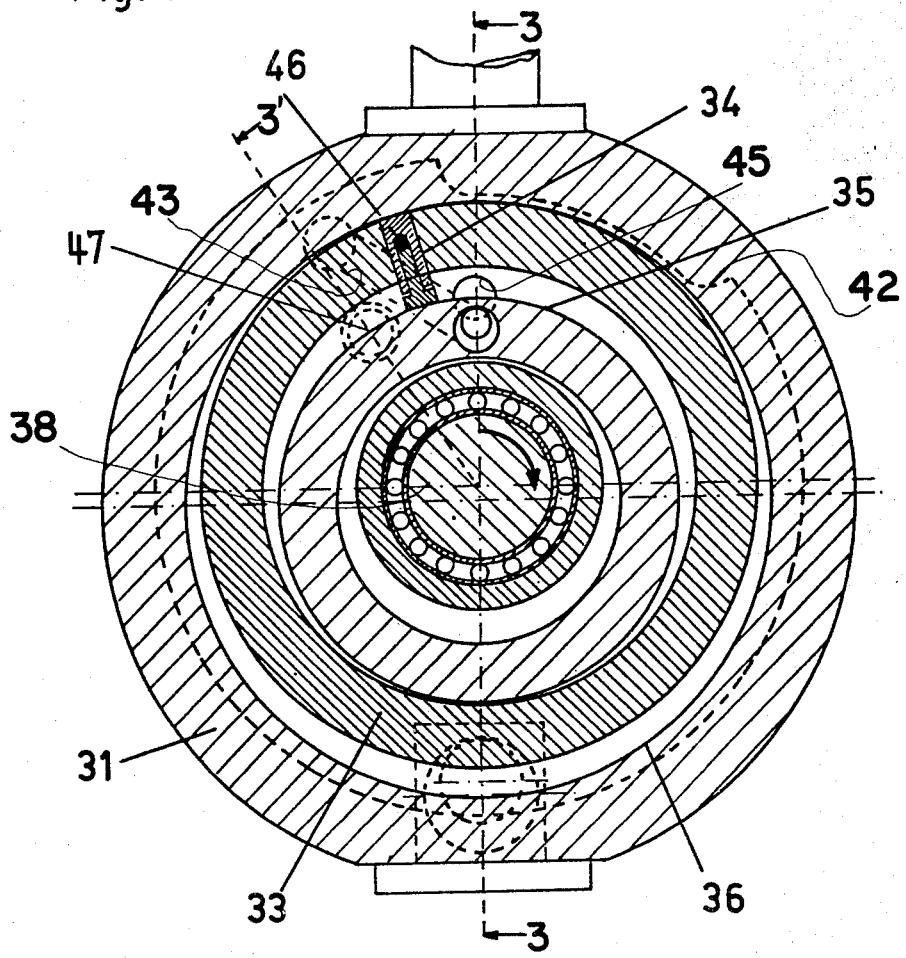
FIG. 4 is a view similar to FIG. 2 taken along line 4—4 of FIG. 3.

FIGS. 3 and 4 show another embodiment of the invention pump with a cylindrical stator chamber which, permit the provision of series-connected pumping stages. FIG. 3 is a sectional view taken along the longitudinal axis, and FIG. 4 is a sectional view perpendicular thereto, taken along the line 4—4 of FIG. 3. The left-hand portion of FIG. 3 corresponds to the section line 3—3, and the right-hand portion to the section line 3'—3 of FIG. 4. This two-part stator chamber is formed by casing parts 31 and 31' and includes the cylindrical annular spaces 32, 32' in which the annular displacer 33 is disposed. The displacer is provided with at least one radial slot for a radially movable slider 34 which is dimensioned so as to contact both the two walls 35 and 36 and the front surfaces 37, 37' of the annular space. In the same manner as in the first embodiment, the displacer is mounted on an eccentric 38 which is secured to a shaft 39 and sealed against the fixed bearing boxes by means of spring bodies 40, 40', in accordance with the invention. Again, the pump is designed so that its left-hand and right-hand portions form separate stages which, however, have a common gas supply through an intake connection 41. By providing that the gas is supplied through recesses 42, (one of which is shown) of rings 49, 49', and passes from the first stage to the second stage through passages 43, 43' and at 45 through the displacer, the intake through the first and second stages is controlled in a manner such that at the critical instants at which, upon reaching the dead center point, the gas might flow back from the discharge side, the intake ports remain closed. They remain closed until an intake space is formed again and the intake and discharge sides are separated by the displacer.

In greater detail, the passage of gas into and through the pump shown in FIGS. 3 and 4 starts with the input of gases into intake 41 and into the annular space between rings 49 and 49'. Thereafter, with the annular displacer 33 moved into a position so that the recesses 42 of the rings 49 and 49' communicate with the chamber formed between the outer surface of the displacer 33 and the inner surface of the housing 31, gas from between the rings 49 and 49' enter this chamber. Further movement of displacer 33 closes off the recesses 42 and compresses the gas within the two chambers. The movement of displacer 33 uncovers grooves at the sides of displacer 33 in the walls of the casing 31 and 31' which, in FIG. 3, is labelled 43'. The further movement of displacer 33 compresses the gas into these grooves and forces it through a channel 43 shown at the left-hand side of FIG. 3. This channel or passage extends axially through a portion of the inner stator part of casing 31 which cooperates with an inner surface of the displacer 33. At the right-hand end of this passage is disposed the passage 45 which extends in the displacer 33 and, at the proper position of the displacer 33, as shown in the left-hand portion of FIG. 3, communicates with the inner chamber defined between the inner surface of displacer 33 and the casing 31. Shortly after this position, the access between passages 43 and 45 is closed due to the continued motion of displacer 33 and the gas in this last-mentioned chamber is compressed and forced out of outlet 14'.

To obtain an optimum sealing of the intake and compression spaces by the sliders, it is advantageous to design them as two-part members which are resiliently movable against each other, for example, enclose a rubber insert 46 accomodated therebetween, so that they contact the cylindrical walls of the stator without play. Ordinarily, the radius of the slider outline approximately corresponds to the contacted cylindrical surface of the stator.

The preferred embodiment with a symmetrical displacer has the advantage of more favorable conduction values for the gas flow inwardly from the intake side. As soon as high speeds are desired, which are possible in themselves, to obtain a high specific suction capacity, the gas dynamics are to be taken into account. Then, the throttling of the intake toward the pump space must be minimized. That is, sufficiently large intake sections and short gas passages from the inlet of the pump to the pump chamber must be provided. For this purpose, this design offers particularly favorable constructional conditions.

If large amounts of gas are delivered, the resistance to flow in the direction of the discharge valve must also be minimized. Then, it is advantageous to provide not a single discharge valve 14, 14', but a plurality of valve openings on each side or a discharge slot along the stator at 47, 47', which are covered by a thin leaf spring, and to provide in the stator a bore extending parallel to the axis, through which the displaced gases pass to the atmosphere.

As will be understood by those skilled in the art, pumps with a higher number of stages may be developed from this two-stage design by providing concentric annular spaces.

The contact pressure chosen for the slider should be somewhat higher than the pressure acting on the slider in the direction of the displacer as the pressure in the compression space reaches its maximum. This pressure depends on how snugly its contact surface at the compression side applies against the cylindrical surface of the stator, as well as on the outside pressure against which the compression takes place and on the conductance of the discharge valve.

Should particularly low contact pressures and a correspondingly small wear of the slider be obtained, the pump may be combined with a forepump which may have a suction capacity smaller by 1 to 2 orders of magnitude. Suitable for this purpose are dry diaphragm pumps, but also oil-sealed rotary pumps if it is ensured that a gas stream is continuously taken in by this oil-sealed pump through a gas ballast or gas intake at the suction side thereof, whereby its delivery pressure is limited downwardly to some mbars and a back diffusion of lubricant vapors into the dry pump is prevented.

While specific embodiments of the invention have been shown and described in detail to illustrate the application of the principles of the invention, it will be understood that the invention may be embodied otherwise without departing from such principles.

We claim:

1. A displacement pump requiring no gas-yielding lubricant in a delivery space thereof comprising:

a stator housing having a cylindrical chamber therein;

a cylindrical displacement body mounted for nonrotating eccentric movement in and about an axis of said cylindrical chamber through gas tight spring bodies connected to the stator housing, defining with said cylindrical chamber the delivery space, said body moved into close association with said housing in said chamber during the eccentric movement thereof to divide said delivery space into an intake space and a discharge space;

said housing having an air intake port communicating with said intake space and a discharge port communicating with said discharge space;

a first sealing slide connected to said body and in sliding contact with a surface of said housing to close communication between said intake port and said intake space and shaped to open communication between said intake port and said intake space only during an intake range of movement of said body; and a second sliding seal mounted for radial movement between said body and said housing for dividing said intake space from said discharge space throughout the entire eccentric movement of said body.

2. A displacement pump according to claim 1, wherein said displacer body is moved into close association with said housing in said chamber during the eccentric movement thereof to form a sealing gap dividing said intake and discharge spaces.

3. A displacement pump according to claim 1 including one additional first sealing slide connected to said body and spaced from said first-mentioned first sealing slide defining therebetween an annular intake recess, said intake port communicating with said annular intake recess, and said first-mentioned and additional first sealing slides dividing said delivery space into parallel acting separate delivery spaces each having parallel acting separate intake and discharge spaces defined by said body.

4. A displacement pump according to claim 3, wherein said first-mentioned and additional sealing slides are positioned on said body to divide said delivery space into equal parallel acting delivery spaces.

5. A rotary displacement pump comprising, a casing including a cylindrical inner surface defining a stator chamber, an inlet connection connected to said casing and communicating with said stator chamber, an outlet connection connected to said casing and communicating with said stator chamber, a displacer body mounted for nonrotating eccentric motion within said stator chamber having an outer cylindrical surface movable into close association with said cylindrical outer surface of said casing along a line, eccentric mounting means connected to said displacer body for moving said displacer body in said stator chamber and moving said line of close association in a circular path around said stator chamber, said displacer body movable into a dead center position with said line of close association in the vicinity of said inlet connection, gas tight spring body means connected between said displacer body and said casing for separating said stator chamber from said eccentric mounting means and preventing rotation of said displacer body, a first slide sealing member connected to said displacer body having at least one recess and movable with said displacer body against a surface of said stator with said recess to close said stator chamber to said inlet connection until said displacer body moves past its dead center position, a second slide sealing member slidably mounted in said displacer body and engaged with said cylindrical inner surface of said casing between said inlet connection and said outlet connection for separating said stator chamber into an inlet space and an outlet space.

6. A rotary displacement pump according to claim 5 wherein said eccentric mounting means comprises a shaft rotatably mounted to said casing and extending through said displacer body, said shaft including an eccentric portion rotatable mounted to said displacer body, said gas tight spring body means comprising at least one spring body member disposed around said shaft for separating said rotational mounting of said shaft to said casing and said eccentric portion to said displacer body from said stator chamber.

7. A rotary displacement pump according to claim 5 wherein said displacer body further includes an annular groove defined therearound adjacent said inlet connection, said first slide sealing member comprising a ring bordering on said groove including said at least one recess, said casing including an annular recess adjacent said inlet connection into which said ring is slidable to close communication between said inlet connection and said stator chamber, said recess in said ring provided to open communication between said recess and said stator chamber when said displacer body moves past its dead center position.

8. A rotary displacement pump according to claim 5 further including bearing means connected between said displacer body and said casing for preventing rotation of said displacer body with respect to said casing.

9. A rotary displacement pump according to claim 5 wherein said stator chamber comprises an annular chamber within said casing, said displacer body including an annular portion eccentricaly movable within said annular chamber, said annular portion having an outer and an inner surface, said annular chamber having an outer and inner surface, with said outer and inner surface of said annular portion of said displacer body moving toward and away from said inner and outer surfaces respectively of said annular chamber for forming outer and inner stator chambers respectively.

10. A rotary displacement pump according to claim 9 wherein said casing further includes passages communicating said inner and outer stator chambers.

* * * * *